US007520689B2

(12) United States Patent
Lane

(10) Patent No.: US 7,520,689 B2
(45) Date of Patent: Apr. 21, 2009

(54) ADJUSTABLE KEYBOARD PALMREST

(75) Inventor: David Michael Lane, Sammamish, WA (US)

(73) Assignee: Microsoft Corporation, Redmond, WA (US)

( * ) Notice: Subject to any disclaimer, the term of this patent is extended or adjusted under 35 U.S.C. 154(b) by 464 days.

(21) Appl. No.: 11/170,150

(22) Filed: Jun. 30, 2005

(65) Prior Publication Data

US 2007/0014621 A1 Jan. 18, 2007

(51) Int. Cl.
*B43L 15/00* (2006.01)

(52) U.S. Cl. ..... 400/715; 248/118; 248/118.3; 248/918

(58) Field of Classification Search ..... 400/715; 248/118, 118.1, 118.3, 118.5, 918
See application file for complete search history.

(56) References Cited

U.S. PATENT DOCUMENTS 5,386,956 A * 2/1995 Hatcher ..... 248/118
5,568,907 A * 10/1996 Wolfe et al. ..... 248/118
5,829,899 A * 11/1998 Chao ..... 400/715
5,833,378 A * 11/1998 Gibson ..... 400/472
5,961,231 A * 10/1999 Ambrose ..... 400/472
6,076,784 A * 6/2000 Selker ..... 248/118
D428,888 S 8/2000 Ledbetter et al.
6,158,359 A * 12/2000 Allan et al. ..... 108/93
6,195,255 B1 * 2/2001 Kim ..... 361/683
6,390,423 B1 5/2002 Danzyger et al.
6,700,564 B2 3/2004 McLoone et al.
6,712,535 B2 3/2004 McLoone et al.
7,389,962 B2 * 6/2008 Rosiello ..... 248/118.3
2008/0023597 A1 * 1/2008 Wyner et al. ..... 248/118.3

OTHER PUBLICATIONS

Ergonomic-Gel Wrist Rest, http://www.marvic.net/cata/gel.htm, date printed Mar. 2, 2005, 2 pages.
Air Tech, WR510-3M™ Adjustable Gel Wrist Rest for Keyboard, http://www.airtech.net/wr3madgelwrr.html, date printed Mar. 2, 2005, 1 page.
Kensington® Adjustable Gel Keyboard Platform Model 34702, http://www.kensington.com/html/5589.html, date printed Mar. 2, 2005, 3 pages.
Kensington® Adjustable Gel Wrist Rest Model 22701, http://www.kensington.com/html/5603.html, date printed Mar. 3, 2005, 1 page.
3M Curved Ergonomic Keyboard Gel Wrist Rest, Product No. MMMWR314MB, http://www.cleansweepsupply.com/pages/skugroup33787.html, date printed Mar. 2, 2005, 2 pages.
3M Height-Adjustable Gel-Filled Wrist Rest, http://www.cleansweepsupply.com/pages/skugroup26323.html, date printed Mar. 2, 2005, 2 pages.

(Continued)

*Primary Examiner*—Leslie J Evanisko
(74) *Attorney, Agent, or Firm*—Merchant & Gould

(57) ABSTRACT

A keyboard having a housing, a palm rest platform movably coupled to the housing and a lift mechanism configured to adjust the palm rest platform is described. Through use of hot keys on the keyboard or a user interface on the computer, the palm rest can be automatically adjusted to preferred positions for a number of users by a motor.

14 Claims, 10 Drawing Sheets

OTHER PUBLICATIONS

3M™ Gel Wrist Rest For Ergonomic Keyboards WR314MG, http://products3.3m.com/catalog/us/en001/office/computer_workstation/node_2ZD8MC445Jgs/root_GST1T..., dated printed Mar. 2, 2005, 2 pages.

3M™ Professional Series II Gel Wrist Rest for Keyboard, Product No. MMMWR420, http://www.cleansweepsupply.com/pages/skugroup33042.html, date printed Mar. 2, 2005, 2 pages.

3M™ Designer Series Gel Wrist Rest for Standard Keyboards, http://www.cleansweepsupply.com/pages/skugroup26316.html, date printed Mar. 2, 2005, 2 pages.

Obusforme® Computer Accessories, http://globaltotaloffice.com/usa2004/obusforme_computer_accessories.html, date printed Mar. 31, 2005, 3 pages.

Microsoft Mouse and Keyboard Hardware-Keyboard Products, http://www.microsoft.com/hardware/mouseandkeyboard/productlist.aspx?type=Keyboard, date printed Apr. 4, 2005, 2 pages.

Microsoft Mouse and Keyboard Hardware-Digital Media Keyboard Pro, http://www.microsoft.com/hardware/mouseandkeyboard/productdetails.aspx?pid=030, date printed Apr. 4, 2005, 2 pages.

Microsoft Mouse and Keyboard Hardware-Natural MultiMedia Keyboard, http://www.microsoft.com/hardware/mouseandkeyboard/productdetails.aspx?pid=019, date printed Apr. 4, 2005, 1 page.

Microsoft Mouse and Keyboard Hardware-Natural Keyboard Elite, http://www.microsoft.com/hardware/mousecandkeyboard/productdetails.aspx?pid=022, date printed Apr. 4, 2005, 1 page.

Microsoft Mouse and Keyboard Hardware-Internet Keyboard, http://www.microsoft.com/hardware/mouseandkeyboard/productdetails.aspx?pid=021, date printed Apr. 4, 2005, 1 page.

Microsoft Mouse and Keyboard Hardware—Business Hardware Pack, http://www.microsoft.com/hardware/mouseandkeyboard/productdetails.aspx?pid=037, date printed Apr. 4, 2005, 1 page.

* cited by examiner

ADJUSTABLE KEYBOARD PALMREST

BACKGROUND

Users of computers often spend significant periods of time on a daily basis typing on keyboards. For example, a palm rest is a feature that will sometimes be utilized with a keyboard to provide comfort and ergonomic correctness. Additionally, certain keyboards will have contours designed to fit the hands and arms of the average human body. Many keyboards have manually extendable legs to let users utilize the keyboard in either flat or inclined position/configuration. Moreover a keyboard with increased comfort and ergonomics is still desired.

SUMMARY

To overcome limitations in the prior art described above, and to overcome other limitations that will be apparent upon reading and understanding the present specification, the present invention is directed to an adjustable keyboard palm rest and various raising and lowering mechanisms for adjusting the positioning of the palm rest.

A first aspect of the invention provides for a keyboard with an integrated adjustable palm rest. Controlled by a user, the palm rest may be adjusted to a variety of positions either manually or by a motorized mechanism. A user in manually controlled adjustable palm rests applies a force, for example a rotational force, to a user interface element which via a cam mechanism causes a lifting mechanism to cause the palm rest to be re-positioned. A user of a motorized adjustable palm rest makes inputs to a user interface, which passes these signals on to a motor as control signals, causing the motor to re-position the palm rest.

A second aspect of the invention provides a lifting mechanism for raising and lowering a palm rest as a result of a user turning of a wheel. A user turns a wheel on the side of the keyboard and through a gear reduction, a lead screw is turned. Attached to the lead screw are cam blocks and the cam blocks are caused to be moved by rotation of the lead screw. The cam blocks, which are also attached to the palm rest, move the palm rest up and down without discrete stopping points, and without a requirement for a locking mechanism. Thus a mechanism for nearly infinite adjustability of a palm rest is provided.

A third aspect of the invention provides a lifting mechanism for raising and lowering a palm rest driven by a small electric motor. In lieu of a user interface member, for example a wheel that needs to be rotated by a user, buttons or similar user input features can be used to receiver user inputs to control the operation of the DC motor, thereby controlling the position of the palm rest.

A fourth aspect of the invention provides for a tie-in between a motorized adjustable palm rest and the operating system of a computer. Upon user login, or entry of another characterizing entry related to a particular user of a computer system, signals are sent to control a DC electric motor so as to cause the palm rest to be positioned at a specific location setting associated with that particular characterizing entry. A preferred user setting may typically be set as a default by the user during the user's first utilization of the computer system. Additionally, the associated settings can be easily reprogrammed and altered should the user's preferences change. A specific palm rest position setting may be set for a number of users.

A fifth aspect of the invention provides for a computer-readable medium.

DRAWINGS

A more complete understanding of the present invention and the advantages thereof may be acquired by referring to the following description in consideration of the accompanying drawings, in which like reference numbers indicate like features, and wherein.

DETAILED DESCRIPTION

In the following description of the various embodiments, reference is made to the accompanying drawings, which form a part hereof, and in which is shown by way of illustration various embodiments in which the invention may be practiced. It is to be understood that other embodiments may be utilized and structural and functional modifications may be made without departing from the scope of the present invention.

Figure 1:
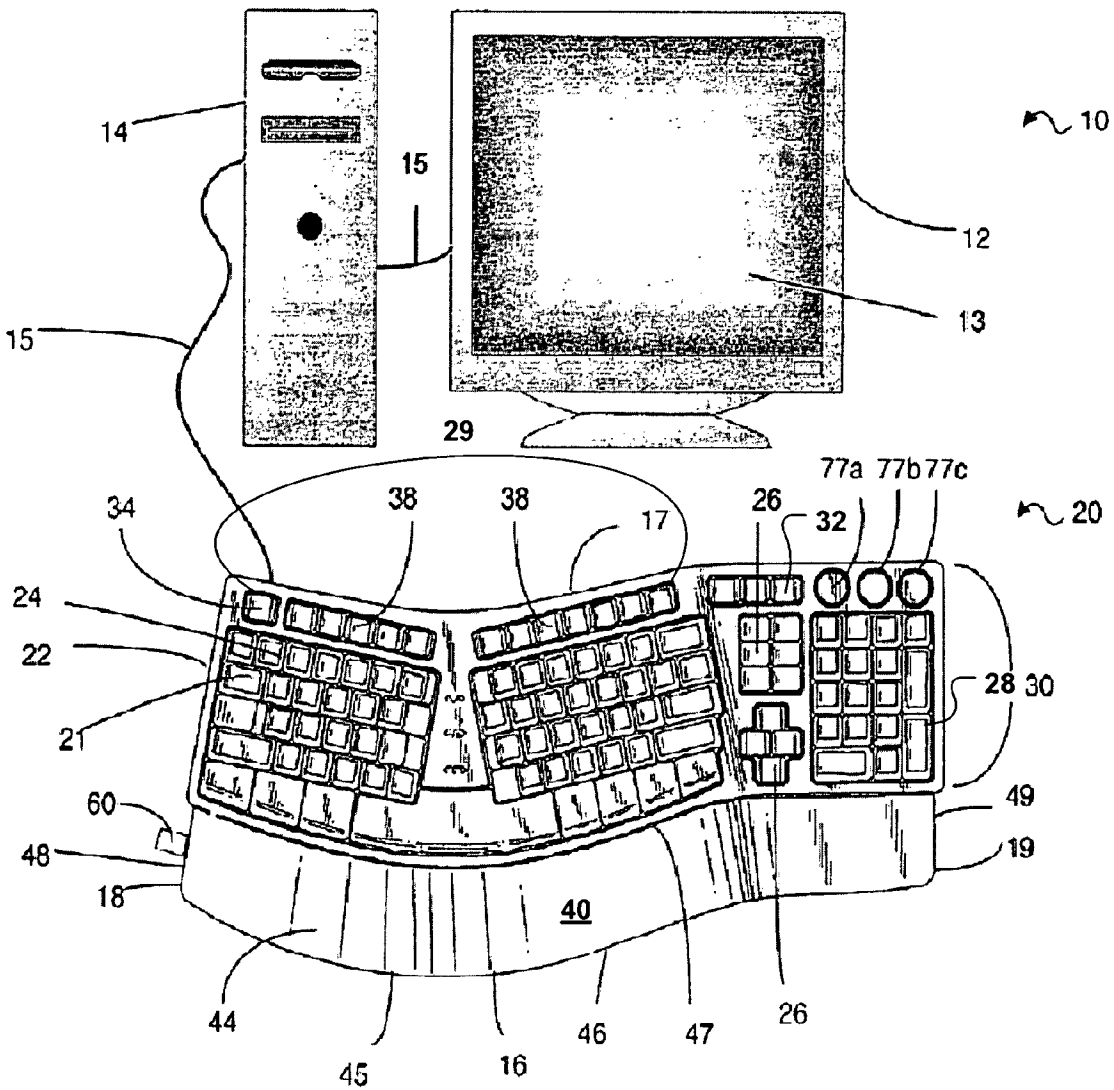
FIG. 1 illustrates a top view of an exemplary schematic diagram of a keyboard in an exemplary operating environment with an integrated adjustable palm rest.

With reference to FIG. 1, an exemplary system for implementing the invention, for example a workstation 10, includes a keyboard 20, a CPU 14, and a display 12 including a screen 13 such as an LCD, cathrode or plasma screen. Keyboard 20, CPU 14, and display 12 may be connected by a connection 15, which may be a wireless connection or a cable connection as depicted in FIG. 1. Keyboard 20, as depicted, includes keyboard region 30, an adjustable palm rest 40, and palm rest user interface 60 for controlling the positioning of adjustable palm rest 40. Keyboard region 30 includes keys and other user input structures described in more detail later. Palm rest region 40 provides a support structure for a user's hands and wrists so as to facilitate comfortable user input to keyboard 20 in general, typically to keyboard region 30. Palm rest region 40 and palm rest user interface 60 are described in more detail later.

For reference purposes, the keyboard 20 has a front edge 16 adjacent the user during normal use, and a back edge 17 distal from the user during normal use. Accordingly, an object is said herein to be "behind" another object when it is between that object and the back edge 17. An object is said herein to be "directly behind" another object when it is between that object and the back edge 17 and at least partially located within the lateral bounds of that object extending in the front-to-back direction. An object is said herein to be "entirely directly behind" another object when it is between that object and the back edge 17 and entirely located within the lateral bounds of that object extending in the front-to-back direction. An object is said herein to be "in front of" another object when it is between that object and the front edge 16. Further, the keyboard 20 also has left and right edges 18 and 19. The direction "lateral" defines the general directions from the left edge 18 to the right edge 19 and from the right edge 19 to the left edge 18. Additionally, keyboard 20 has opposing faces, a top surface 21 which generally has keys attached to it and acts as a user input surface and a base 22 used for support, balance or housing of components. Additionally, for reference purposes, adjustable palm rest 40 may be referred to as having a front edge 46, a back edge 47 and left and right edges 48 and 49. A user typically rests her hands and, wrists and palms on a top surface 44 of palm rest 40.

In a preferred embodiment, the keyboard 20 includes an alphanumeric section 24, an editing section 26, a numeric section 28, and a function section 29. The alphanumeric section 24, sometimes referred to as the QWERTY section, may include keys for each of the letters of the alphabet, each of the digits 0-9, and various punctuation symbols. The alphanumeric section 24 may alternatively be a subset of these keys. In this embodiment, the editing section 26, is located immediately to the right of the alphanumeric section 24, and may include four arrow keys, Delete, Home, End, PageUp, and PageDown keys. The numeric section 28 is located to the right of the editing section 26. The numeric section 28 includes at least digit keys 0-9, arithmetic function keys /, *, –, and +, a decimal separator key, and an Enter key. The function section 29 includes an Escape (or Esc) key 34 and one or more groups 38 of keys behind the alphanumeric section 24, one or more groups 36 of keys behind the numeric section 28, and one or more groups 32 of keys behind the editing section 26. These keys preferably form a laterally extending row. The keys in this row may be standard function keys and/or may be command keys preferably labeled according to the command they perform when pressed. The keys need not be limited to the key as labeled. Additionally, the keyboard 20 may include a laterally extending row of "launch" or additional command keys located behind the row of keys in the function section 29. While the embodiment of FIG. 1 depicts a split keyboard, conventional keyboards, keyboards that have an alphanumeric section 24 that may be raised, and other ergonomic keyboard designs, may also be utilized.

Figure 2:
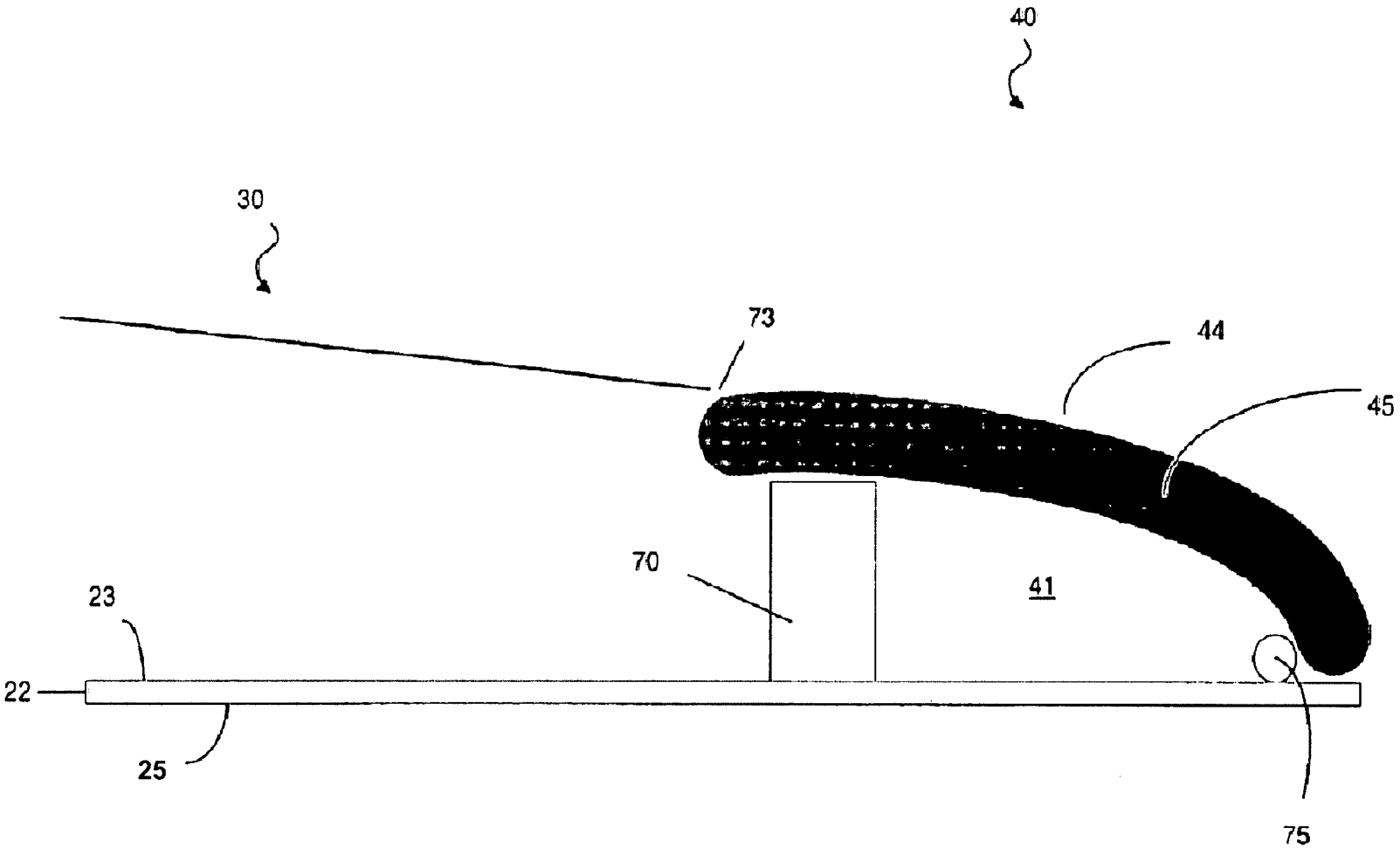
FIG. 2 illustrates a side view schematic diagram of an exemplary embodiment of an integrated hinged adjustable palm rest.

FIG. 2 illustrates a side view of a schematic diagram of an exemplary embodiment of adjustable palm rest 40. The depicted exemplary palm rest 40 includes palm rest platform 45, hinge point 75, lift mechanism 70, and cavity 41. In this embodiment, palm rest 40 is integrated into keyboard 20 such that base 22, having a top surface 23 and bottom surface 24, acts as a support surface for palm rest 40 and houses features of palm rest 40. Palm rest 40 abuts the keyboard region of keyboard 20 at reveal 73. "Position," as used herein, is used broadly to refer any of location, orientation, height, angle of rotation etc.

The features of the palm rest 40 described herein can be formed from materials well known in the art. In the illustrative exemplary embodiment, many of the components will be preferably composed of one of a number of plastics. Palm rest platform 45 may also be composed of a desirable plastic. Palm rest platform 45 possesses sufficient rigidity to provide support to the wrist and hands of a user while also possessing a minimal amount of give so as to provide the user comfort. Palm rest platform 45 may be a single material solid structure or it may also be a multi-layered body. For example, palm rest platform 45 may include an outer fabric covering wrapped about a filling material such as plastic, polystyrene, gel, or other filler materials. Palm rest platform 45 may also have a rigid bottom surface for engagement with lift mechanism 70. Palm rest platform 45 typically possesses a smooth continuous shape. Among the preferred shapes may be a generally convex shape so as to provide a comfortable resting surface for users to place their hands and wrists.

Cavity 41 is an interior region of palm rest 40 and may be hollow or filled with palm rest filler material. Cavity 41 typically houses lift mechanism 70. If adjustable palm rest 40 is motorized cavity 41 also may house motors, portable power supplies including batteries and other associated components. Hinge 75, also may be housed by cavity 41. Hinge 75 may be any of a number of elements used to guide movements of elements such as palm rest platform 45 including bearings, wheels, axis, inclined planes etc.

Generally, to adjust the positioning of palm rest 40, a lift mechanism 70 provides a force to palm rest platform 45 causing palm rest platform 45 to be moved in the direction of the applied force. As depicted palm rest platform 45 sits in an initial resting position abutted against both top surface 23 of keyboard bottom surface 22 and hinge 75 so as to permit guided motion about a hinge point. As lift mechanism 70 acts on palm rest platform 45, palm rest platform 45 is caused to move in a direction consistent with the force supplied by lift mechanism 70. The force applied by lift mechanism 70 to one end of the palm rest platform 45 causes the palm rest platform 45 to have a varied position since palm rest platform 45 has a certain rigidity to it and the movement resulting from the force applied by lift mechanism 70 causes points along the palm rest platform 45 to have a varied position be it by orientation, rotation, or location. Lift mechanism 70, while described for illustrative purposes as raising palm rest platform 45 and thus palm rest 40, also lowers palm rest 45 and thus palm rest 40 in a similar manner as described through out the specification with a merely reverse direction of motion, as one skilled in the art understands. Additionally, lift mechanism 70 continually provides support to palm rest platform 45 even when no adjustment is being made to the position of the palm rest.

While the adjustment of palm rest 40 depicted in FIG. 2 has been described with an active lift mechanism 70, alternatively, in another related embodiment, lift mechanism 70 may be a support member and palm rest platform 45 may be adjusted by a user directly placing force on palm rest platform 45 causing movement about hinge 75. Once adjusted to a desired a position, palm rest platform 45 is locked in place.

While the exact path and range of motion can be varied from embodiment to embodiment, the various embodiments of palm rest 40 are configured to enable a user to vary the height of the palm rest platform 45 with respect to the remainder of keyboard 20. Various ranges of operability may be achieved depending on the specific components used to move components of palm rest 40 and a variable range of at least 10 millimeters is desirable in certain keyboards. Additionally, despite palm rest 40 being depicted as a hinged palm rest, various other connection mechanisms are contemplated. For example, slider mechanisms, just to name one may be utilized to be permit sufficient motion to allow palm rest platform 45 to re-positioned while providing sufficient support when a user rests her hands and wrists on the palm rest 40 during use of the keyboard 20.

Figure 3:
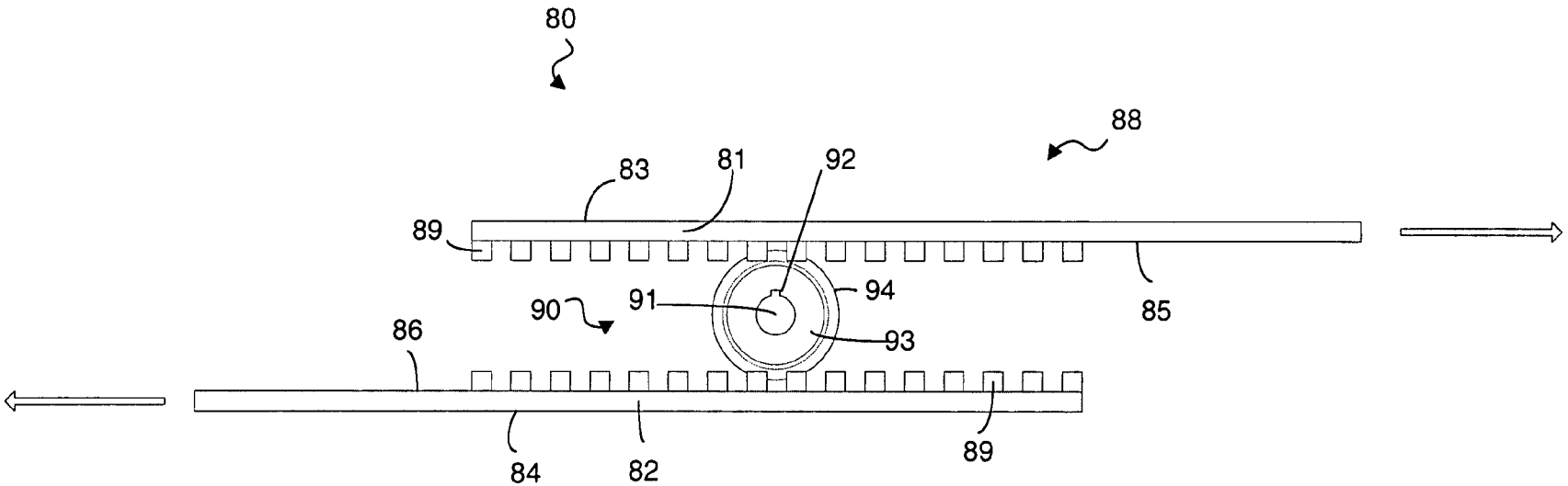
FIG. 3 illustrates a side view schematic diagram of exemplary embodiment of a mechanism for manually adjusting a palm rest.
Figure 8:
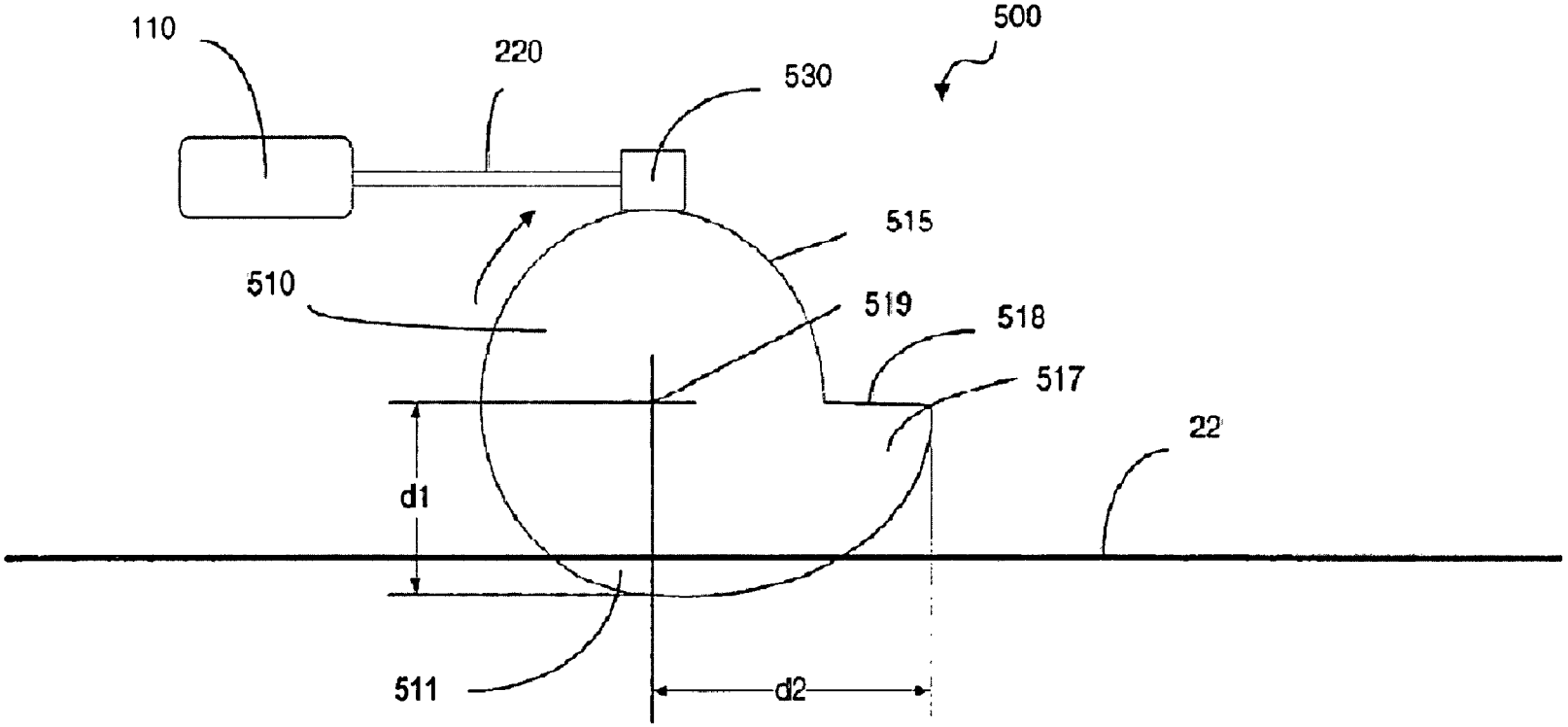
FIG. 8 illustrates a side view schematic diagram of a lift leg mechanism for an adjustable palm rest.
Figure 9A:
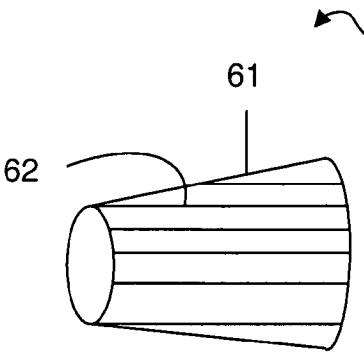
FIGS. 9A-9D illustrate perspective views of exemplary embodiments of user interfaces for manipulating an adjustable palm rest.
Figure 9B:
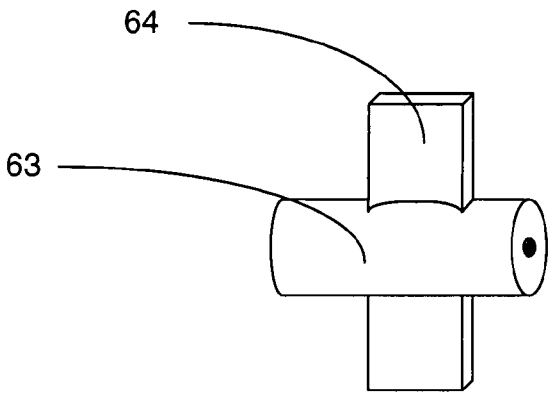

While lift mechanism 70 supplies a force that causes the variation in position of the palm rest platform 45, lift mechanism 70 is controlled and caused to provide a displacing force on palm rest surface as a result of user interaction with user interface 60, which may be either a user interface member in manual embodiments or a user input member in motorized embodiments as is described later. A user may control lift mechanism 70 either manually or via motorized control. FIGS. 3 and 9A-9B illustrate exemplary embodiments of mechanism for manually adjusting palm rest 40, while FIGS. 4-8 and 10-11 illustrate exemplary embodiments of mechanism for adjusting palm rest 40 with a motor.

FIG. 3 illustrates a schematic diagram of an exemplary embodiment of a manual mechanism for adjusting a palm rest. Cam actuator 80 includes a rack 88 driven by a drive mechanism 90. Rack 88 includes a pair of treads, upper tread 81 and lower tread 82. Additionally, each of the upper run 81 and lower run 82 can be described as having inner and outer surfaces. As depicted, upper run 81 has outer surface 83 and inner surface 85. Similarly, lower run 82 has outer surface 84 and inner surface 86. Along each of the inner surfaces 83 and 84, a number of teeth 89 are disposed so as to engage an outer surface 94 of drive mechanism 90. While, not depicted in FIG. 3, gear 90 is configured such that outer surface 94 has numerous teeth complimentary in size and arrangement to the teeth 89 disposed on the inner surfaces 85 and 86 of upper and lower runs of rack 88 so as to be drivably engaged.

Drive mechanism 90 includes a drive gear 93 attached to a drive shaft 91. Key 92 locks drive gear 93 to drive shaft 91, thereby preventing drive shaft 91 from "free spinning" when the outer surface 94 of drive gear 93 frictionally engages teeth 89 disposed on rack 88. Use of a key, such as key 92, to connect rotational components so as to prevent slippage relative to one another is known. While not depicted, on an end opposite the connection to drive gear 93, drive shaft 91 is connected to user interface 60. Typically, user interface 60 in manual embodiments is a knob or related member, various user interfaces 60 may be utilized. See FIGS. 9A-9D. A user, for example rotates user interface 60, thereby directly causing drive shaft 91 to rotate in a certain direction based upon the user's input. As described, this user input to user interface 60 is passed by gear 93 and outer surface 94 (typically toothed) so as to move runs 81 and 82 to drive a lift mechanism so as to vary the position of the palm rest 40. By this manual modification of the positioning of the user interface 60, a preferred specific positioning of palm rest 40 may be achieved. The ends of rack 88 may be connected to palm rest platform 45 directly or via any number of common force relay mechanism to permit force to be placed on palm rest platform member 45 so as to accomplish the desired adjustment. The force relay mechanisms may include scissor lifts, rods, gear configurations, pulleys etc.

Figure 4:
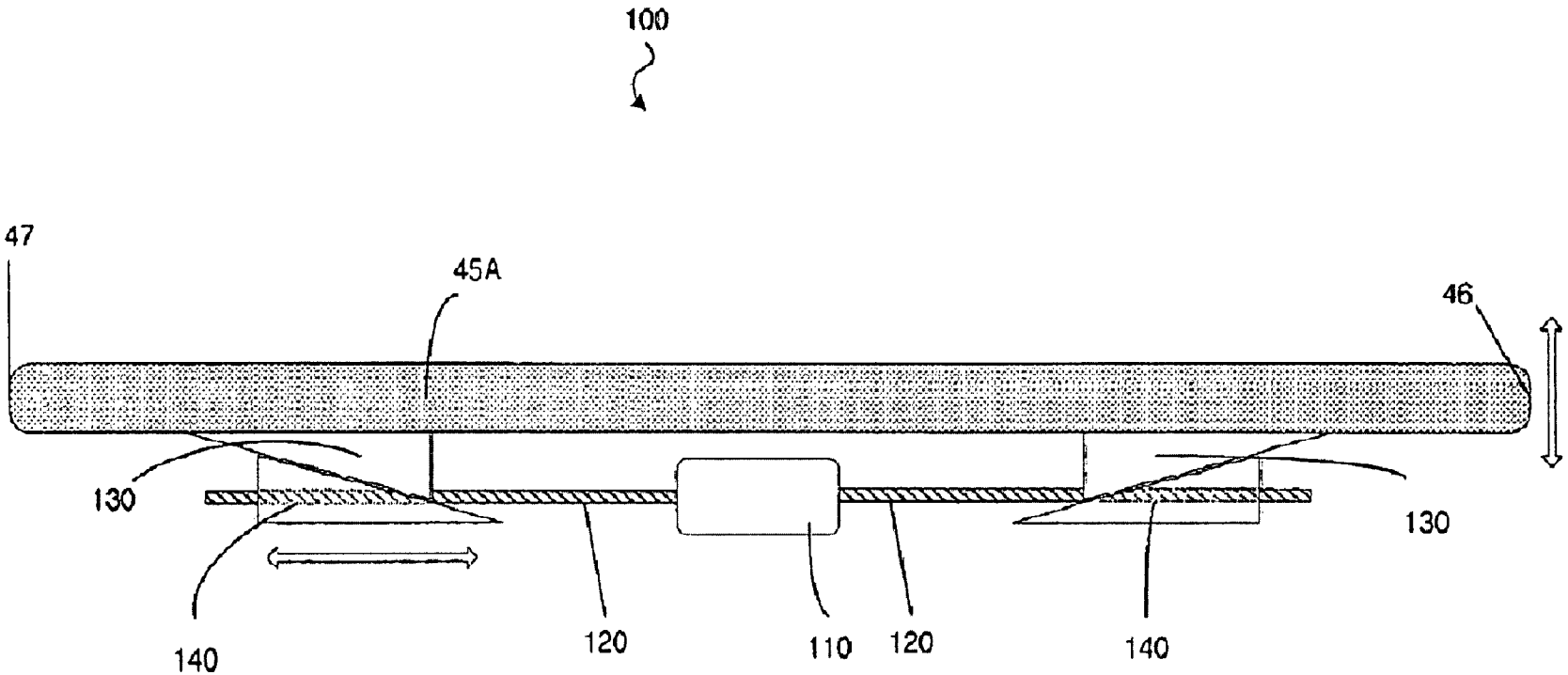
FIG. 4 illustrates a side view schematic diagram of another exemplary embodiment of a mechanism for adjusting a palm rest.

FIG. 4 illustrates a schematic diagram of motorized embodiment of a mechanism for adjusting a palm rest. Motorized cam actuator 100 includes a motor (or a gearbox) 110, lead screw 120 and two pair of cam blocks, upper blocks 130 and lower blocks 140. The lift mechanism, cam actuator 100, is configured such that upper blocks 130 are attached to palm rest platform 45A on a side towards the interior region of a keyboard 20. Opposing in posture, but complimentary in shape for each of the upper blocks 130, sits lower blocks 140. Between each of the two pairs of cam blocks sits motor 110. A lead screw 120 connects motor 110 to each of the lower cam blocks. Depending on the desired positioning of a portion of wrist rest surface element 45, lead screw running to the paired cam blocks is rotated a particular direction. In FIG. 4, front edge 46 of palm rest 40 is to be tilted upward, lead screw 120 is rotated so as to shift lower blocks 140 right thereby causing front edge 46 to be elevated relative to its original position. To raise the back edge 47, lead screw 120 is rotated to shift lower blocks 140 to the left thereby causing back edge 47 to be elevated relative to its original position.

More specifically, lower blocks 140 may be pulled by motor 110 in a given direction towards causing lower blocks 140 to slide over upper blocks 130, which are affixed to palm rest platform 45A. Since upper blocks 130 and lower blocks 140, in this embodiment, are wedged shaped, the palm rest platform is caused to be raised and lowered as each of lower blocks 140 is pulled so as to slide across an engaging surface of upper block 130. Lowering of the palm rest platform 45A is similar, except lead screws 120 are rotated so as to cause lower blocks 140 to be moved outward away from motor 110. Similar to the previous description, lower blocks 140 are forced to slide across a surface of upper block 130, thereby lowering the palm rest platform 45A. The lift mechanisms described herein, such as the one described FIG. 3, may be configured so as to be self-locking. Specifically, the mechanisms remain engaged when not causing the position of the wrist rest to be modified and continuously serves as a support member. Thus, additional parts, which incur added expense and breakage, are not required for locking.

Additionally, a related configuration may be utilized in which each lower cam block is driven independently. The basic features shown in FIG. 4 may be modified such that when lower cam blocks 140 are driven independently by individualized lead screws, the entire palm rest 45 platform may be raised and lowered in unison without varying an angle of orientation relative to the surface keyboard 20 sits on. For example, in this further embodiment each of a plurality lead screws may 120 is rotated such that each of lower blocks is pulled toward motor 110. A plurality of motors 110 or a force redirection mechanism may be utilized to accomplish the desired movement. Additionally, the individualized control of each of the lower blocks 140 also permit motion similar to that described in the embodiment with a single lead screw 120. By placing a plurality of cam block and lead screw mechanisms in palm rest 40, for example one mechanism adjacent edge 48 and one adjacent right edge 49, palm rest platform 45A may be in essence universally adjusted to numerous positions enabling a user very specialized control of the position of palm rest 40.

Figure 5A:
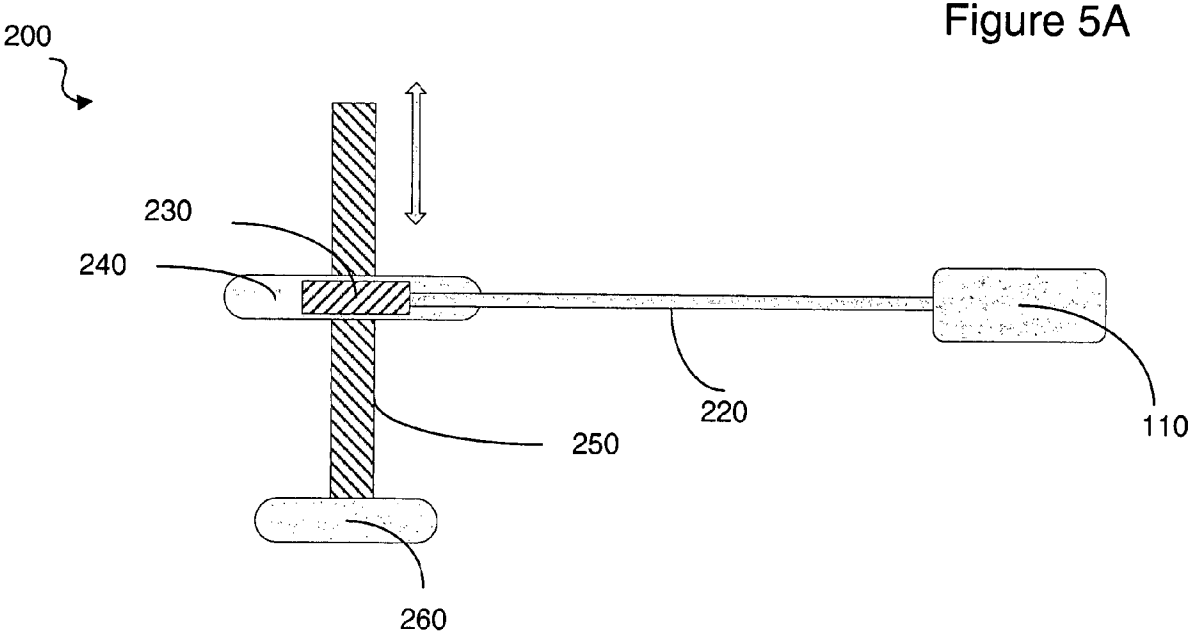
FIGS. 5A and 5B illustrate side and top view schematic diagrams of an exemplary motorized leg mechanism for an adjustable palm rest.
Figure 5B:
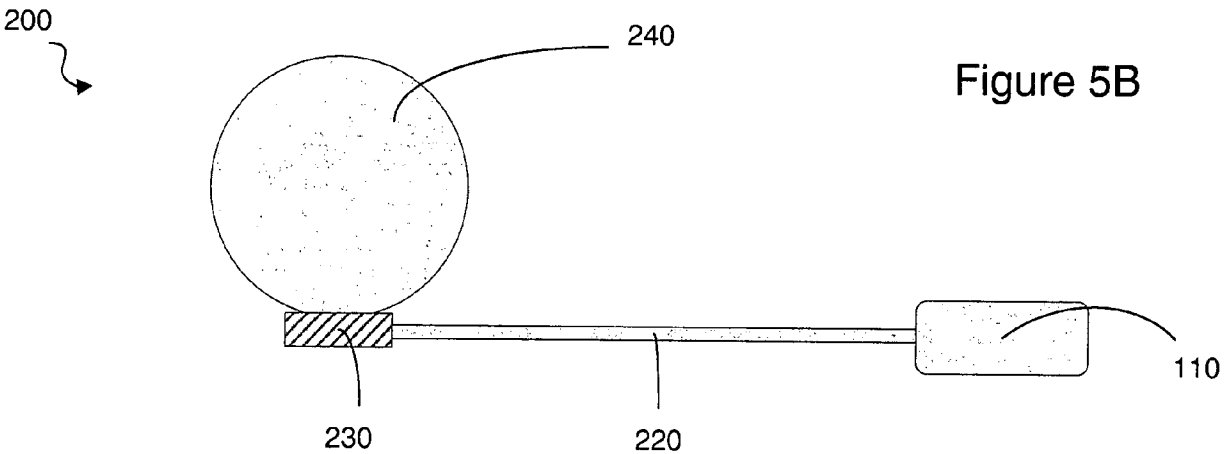

FIGS. 5A and 5B illustrate side and top schematic diagrams of an exemplary leg mechanism for an adjustable palm rest, another mechanism for providing adjustability to a palm rest. Generally, motorized leg 200 includes a motor 110 which rotates drive shaft 220 and drive gear 230 thereby causing gear 240 to rotate. The path of rotation that gear 240 makes may be generally perpendicular to the path of rotation drive gear 230 and drive shaft 220. Hence, gear 240 is utilized to modify the direction of a rotational force provided by motor 110 in a direction to drive lead screw 250 with foot 260 attached at an end. By rotating gear 240, lead screw 220 is caused to rotate since they are coupled together. Depending on the direction of rotation, foot 260, when housed in a keyboard will be extend further towards the support surface causing the palm rest platform 45 height to be increased relative to the rest of the keyboard. Additionally, if foot 260 is retracted by lead screw 220 towards the base of the keyboard, palm rest platform 45 will be decreased relative to a resting surface upon which the a keyboard containing the adjustable palm rest is placed.

Figure 6:
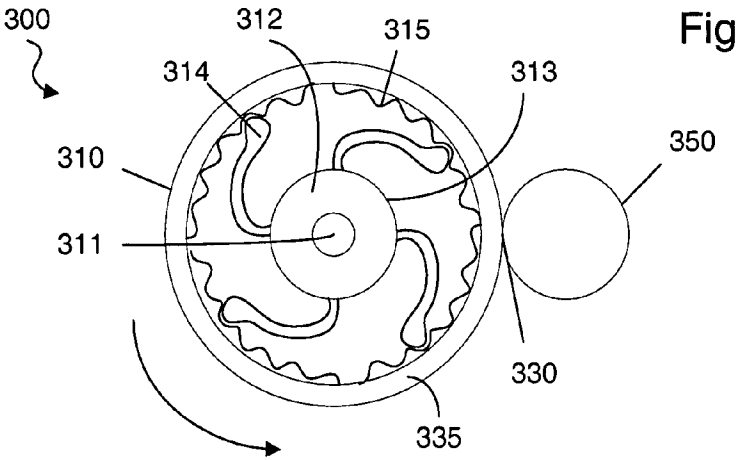
FIG. 6 illustrates a side view schematic diagram of an exemplary clutch mechanism for an adjustable palm rest.

In the embodiments depicted in FIGS. 3-5, as well as later in FIG. 8, various lift mechanisms are depicted for raising and lowering a portion of a palm rest. In these mechanisms, a clutch mechanism may be used to prevent "burn out" when the range of motion has been exhausted while a user or a motor continues to attempt to drive a lift mechanism. FIG. 6 illustrates a schematic diagram of an exemplary clutch mechanism for an adjustable palm rest. Clutch mechanism 300 generally includes a drive gear 310 and a spur gear 350 aligned to engage at a contact surface 330. While not depicted, the outer circumferential edges of drive gear 310 and 350 typically are toothed in a complimentary fashion to facilitate engagement and enable drive gear 310 to drive spur gear 350 via rotational engagement at contact surface 330. Drive gear 310 includes a drive shaft 311 and plate 312 formed or molded together as a central member with a plurality of flexible pawls 314 extending radially about circumference of circular plate 312 and connected to plate 312 at a number of spaced locations on outer edge 313. On an end of the pawl 314 opposite its connection to outer edge 313 of plate 312, pawls 314 are formed to engage ratchet teeth 315, which circumscribe the inner surface of the outer ring 335 of drive gear 310.

To adjust the positioning of a palm rest utilizing clutch mechanism 300, drive gear 310 is rotated and thereby drives spur gear 350. The disparity in size, specifically circumference between drive gear 310 and spur gear 350, reduces the requisite force necessary to cause spur gear to be driven and in turn the palm rest moved. Either manually, for example by a user rotating a user interface knob (see FIG. 1) connected to drive shaft 311, or by user control of a DC motor connected to drive shaft 311, drive shaft 311 and plate 312 is caused to rotate, for example in the direction depicted by the arrow. This rotation of plate 312 via pawls 314 causes drive gear 310 to rotate in a first angular direction as depicted. Spur gear 350, which is engaged with drive gear 310 via complimentary teeth at contact surface 330, is drive by the rotation of drive gear 310 however is caused to rotate in the opposite angular direction as the direction depicted. Through this interaction a lift mechanism can be driven by the clutch mechanism 300. To prevent "burn out" or other problems caused from a force being applied to clutch mechanism 300 in attempt to rotate it when the adjustable palm rest is either in a fully extended or a start position, pawls are 314 are configured so as to slide over ratchet teeth 314 upon application of certain threshold force. When clutch mechanism 300 is used to adjust a palm rest and the end of the range motion is reached, a resultant force will be placed on the mechanism described such that pawls 314 will slide over ratchet teeth 315 rather then bend or break. The specific configuration of the pawls 314 to act accordingly is well known and may be varied depending on desired design considerations such as size or material. Additionally, by using a clutch mechanism 300 in a lift mechanism of an adjustable palm rest, additional discrete locking mechanisms to hold palm rest 40 in place once it has been repositioned are not needed. As evident in FIG. 6, the shape and characteristics of pawls 314 may be utilized as a locking mechanism thereby preventing reverse motion in the direction opposite the arrows. Specifically, pawls 314 include a shape and posture resistive to typical forces applied by the weight of a user resting palms, wrist or hands on palm rest 40 during conventional keyboard use as pawls 314 possess increased rigidity when forces are applied against them in the reverse direction. If a user pushes down on a palm rest 40, this reverse force will be passed through various structures back to spur gear 350 which in turn will try to turn drive gear 310 in an opposite direction the as depicted by the illustrative arrow. However, because of the configuration of pawls 314 and ratchet teeth 315, an exterior force supplied from spur gear 350 will not cause drive gear 310 to rotate as the gear is locked in place by pawls 314 and ratchet teeth 315.

Figure 7:
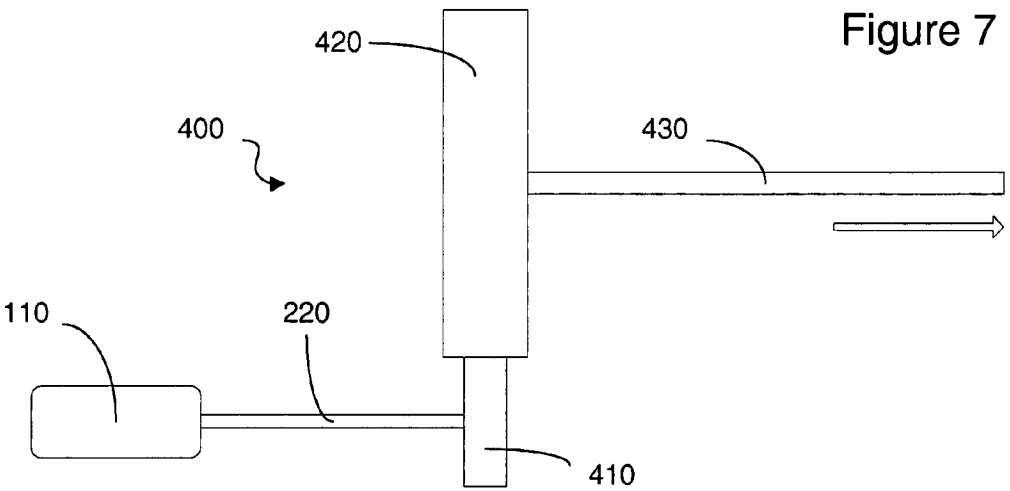
FIG. 7 illustrates a side view schematic diagram of an exemplary gear reduction mechanism for an adjustable palm rest.

FIG. 7 illustrates a schematic diagram of an exemplary lift mechanism for an adjustable palm rest. In this embodiment, gear reduction mechanism 400 includes a small gear 410 and a big gear 420. As shown, small gear 410 fits inside an inner hole of big gear 420. This inner surface is typically toothed and the interaction between small gear 410 and big gear 420 is well known as internal spur gears are well known in the art. Additionally, clutch mechanism 300 may be incorporated into gear reduction mechanism 400, to provide additional features that accompany clutch mechanism 300. In utilizing gear reduction mechanism 400 to drive an adjustable palm rest, motor 110 is connected to small gear 410 via drive shaft 220. Another drive shaft 430 connects big gear 420 to the raising and lowering mechanism utilized in this particular palm rest. Thus when utilized to drive a palm rest lift mechanism, motor 110 rotates a drive shaft 220. Small gear 410 is connected to drive shaft 220 and is rotated by drive shaft 220, also converting at least the direction of rotation. Small gear interacts with big gear 420 causing it to rotate thereby altering the velocity of the shaft. Attached to big gear 420 is drive shaft 430, which converts the direction of rotation and rotates complimentary components of the raising and lowering mechanism to cause palm rest 40 to be modified.

Another embodiment of a lift mechanism is a self locking eccentric cam lift leg. FIG. 8 illustrates a schematic diagram of a self locking cam lift leg for an adjustable palm rest. A self locking eccentric cam lift leg mechanism 500 includes cam lift leg 510 which has a generally circular outer surface 515 and an elliptical irregular protrusion 517. A spur gear 530 engages the outer surface 515 in a manner similar to the other previously described mechanism. For example, outer surface may include teeth that compliment teeth on an outer surface of spur gear 530 to assist spur gear 530 in driving cam lift leg 510. Spur gear 530 is connected by a drive shaft 220 to motor 110, which drives spur gear 530 via drive shaft 220. As spur gear 530 causes cam lift leg 510 to rotate in a direction indicated by the illustrative arrow, a specific portion of cam lift leg 510 that sits below base 22, referred to for reference as foot 511, is varied. Cam lift leg 510 is fixed at an axis point 519 to keyboard 20, for example base 22. Cam lift leg 510 rotates about axis point 519 in the direction depicted. As irregular protrusion 517 in FIG. 8 continues to move toward foot 511 the distance between base of keyboard 20 and specifically palm rest 40 is increased relative to a start position. Thus palm rest 40 is raised as palm rest support surface 45. Thus, as cam lift leg 510 rotates as depicted and irregular protrusion 517 moves toward the location of foot 511, the height of palm rest platform 45 is increased. Using the lift mechanism of FIG. 8, a maximum height of a palm rest platform 45 can be achieved when a flat surface 518 of irregular protrusion 517 is perpendicular to base 22. Also, specific adjustability features may be selected when utilizing the mechanism of FIG. 8, as the range of vertical travel is equivalent to a measurement d1 subtracted from a measurement d2, as depicted. For example, a cam lift leg 510 possessing a d2 dimension of 15 mm and a d1 dimension of 5 mm has a vertical travel of 10 mm.

Generally, an adjustable palm rest and associated lift mechanisms described herein may be utilized in any of a number of keyboard designs. An adjustable palm rest may be utilized in standard, natural, and various ergonomically designed keyboards. Ergonomic keyboards including keyboards in which the alphanumeric section 24, or Qwerty section as it is often referred to, may be positioned to be generally perpendicular or at least inclined with respect to the conventional typing surface work are also contemplated as including adjustable palm rest like the ones described herein. Each of these specific keyboard types and configurations may be integrated with an adjustable keyboard palm rest.

Figure 9C:
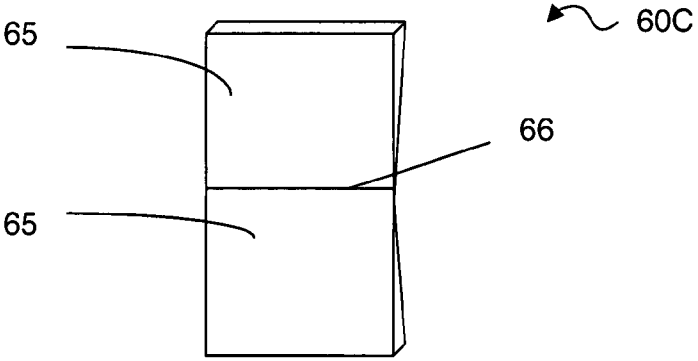
Figure 9D:
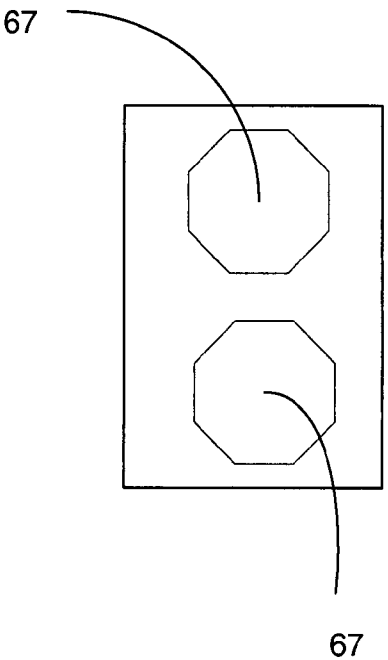

Additionally, preference with respect to user interfaces vary from user to user. As such, FIGS. 9A-9B illustrate exemplary embodiments of a user interface for manipulating an adjustable palm rest. FIGS. 9A-9B illustrate exemplary embodiments of a user interface 60, e.g. user interface member, for manually powered lift mechanisms, and FIGS. 9C-9D illustrate exemplary embodiments of a user interface 60, e.g. user input feature, for a motorized lift mechanism, however various mechanisms may be used in conjunction with both manual and motorized lift mechanisms. FIG. 9A depicts a user interface 60A including a frustro-conical body member 61 with ridges 62 circumscribing the perimeter. FIG. 9B depicts a user interface 60B including a cylindrical housing 63 and a pair of paddles 64 for user grip extending from cylindrical housing 63. As is apparent, user interfaces 60A and 60B are configured to provide ease of grip to a user. FIG. 9C depicts a user interface 60C including a raised button having two wedge sides 65 and dividing line 66 running across the middle. When one of the sides is depressed, a user input is received. If the user is not making an input, both wedge sides 65 of user interface 600 remain elevated rather than depressed. FIG. 9D depicts a user interface 60D having a pair of buttons 67. A user holds each of the buttons 67 down to make an input. When a depressed button 67 is released by the user, the depressed button 67 returns to its raised position.

Should multiple users in a household share a computer and accompanying keyboard, or should a single user operate a keyboard in multiple positions, such as various ergonomic work positions, control of the described mechanisms may be integrated into the computer software and/or operating system. Specifically, motor 110 may be connected to the computer and controlled as a peripheral either through a keyboard housing, motor, adjustable palm rest, or as a distinct entity. In one embodiment, a user may position, either through keyboard input or input via user interface 60, palm rest 40 into a preferred positioning. The user instructs the computer to save this setting as that user's default setting. The computer stores the positioning settings as being tied to user specific information, for example a user id, login or password. Then, upon subsequent entry by a user of the id, login, or password, motor 110 would be controlled to position palm rest 40, specifically palm rest platform 45 into the user's default or preferred positioning. In this embodiment, the user only needs to determine a preferred positioning once, eliminating a need for user adjustments each time a user utilizes the computer and keyboard. Similarly, if multiple users in a household or office utilized the same computer and keyboard, a preferred position for each user may be tied to entry of user specific information such as an id, login, or password.

Further, as illustrated in FIG. 1, the keyboard 20 may be configured with one or more "hot keys" 77*a*, 77*b*, and 77*c* such that depression of the "hot keys" causes motor 110 to position, via one of the described lift mechanisms, palm rest 40 to a user desired position. The "hot key" may be set to correspond to a position by the user during one of the user's initial utilization of the computer thereby eliminating the need for subsequent adjustment of the palm rest. Similarly, several "hot keys" may be utilized, each "hot key" corresponding to a different user. For example, depression of key 77*a* causes a motor 110 to cause adjustment of palm rest 40 to a first user's previously selected position. Similarly, depression of keys 77*b* and 77*c* will cause adjustment off palm rest 40 to a second and third user's previously selected position.

Figure 11:
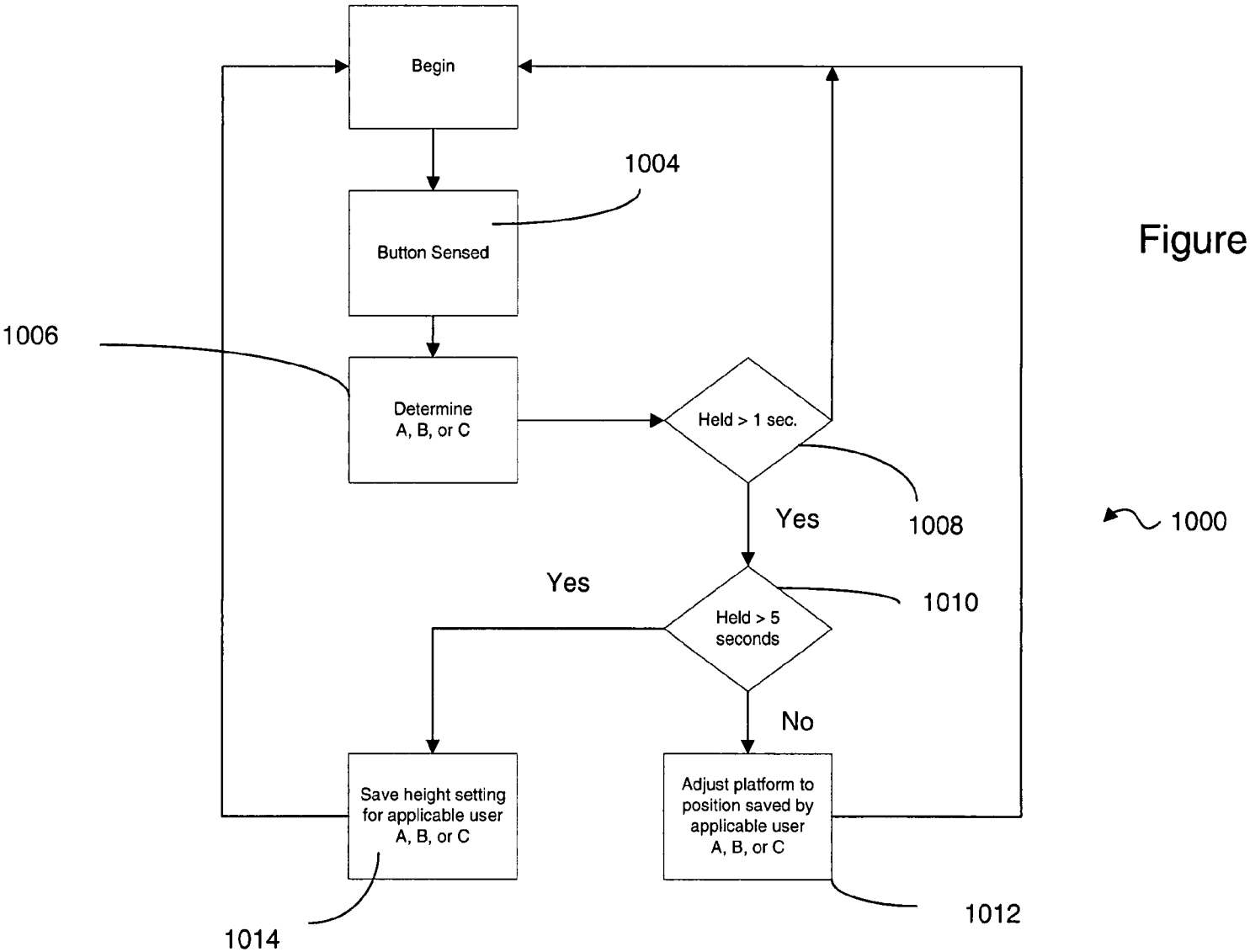
FIG. 11 illustrates a schematic diagram of an exemplary embodiment of control logic for manipulating an adjustable palm rest.

FIG. 11 illustrates an exemplary flow diagram 1000 used to control a motor so as to operably connect depression of one of the hot keys 77*a*, 77*b*, and 77*c* to motor 110 movement so as to adjust palm rest 40. Upon sensing 1004 of one of hot keys 77*a-c* being depressed, a determination 1006 is made as to which specific button has been pressed. Next, a time determination 1008 is made, for example, whether the button has been held for more than 1 second so as to prevent accidental and inadvertent adjustments. If the hot key has been held so as to satisfy the first time determination 1008, a second time determination 1010, for example, whether the key has been pressed for more than 5 seconds. If second time determination 1010 is not satisfied ("no"), the platform is caused 1012 to be adjusted to a previously saved user position depending on which of keys 77*a-c* was depressed, and the analysis then begins again. If time determination 1010 has been satisfied, the current height setting is saved 1014 for a user, e.g. for a specific key 77*a*, 77*b* or 77*c* and the analysis is begun again. In this manner, a single key may be used to cause adjustment of palm rest 40 to a preferred position and to also set the associated preferred position for a user.

Figure 10:
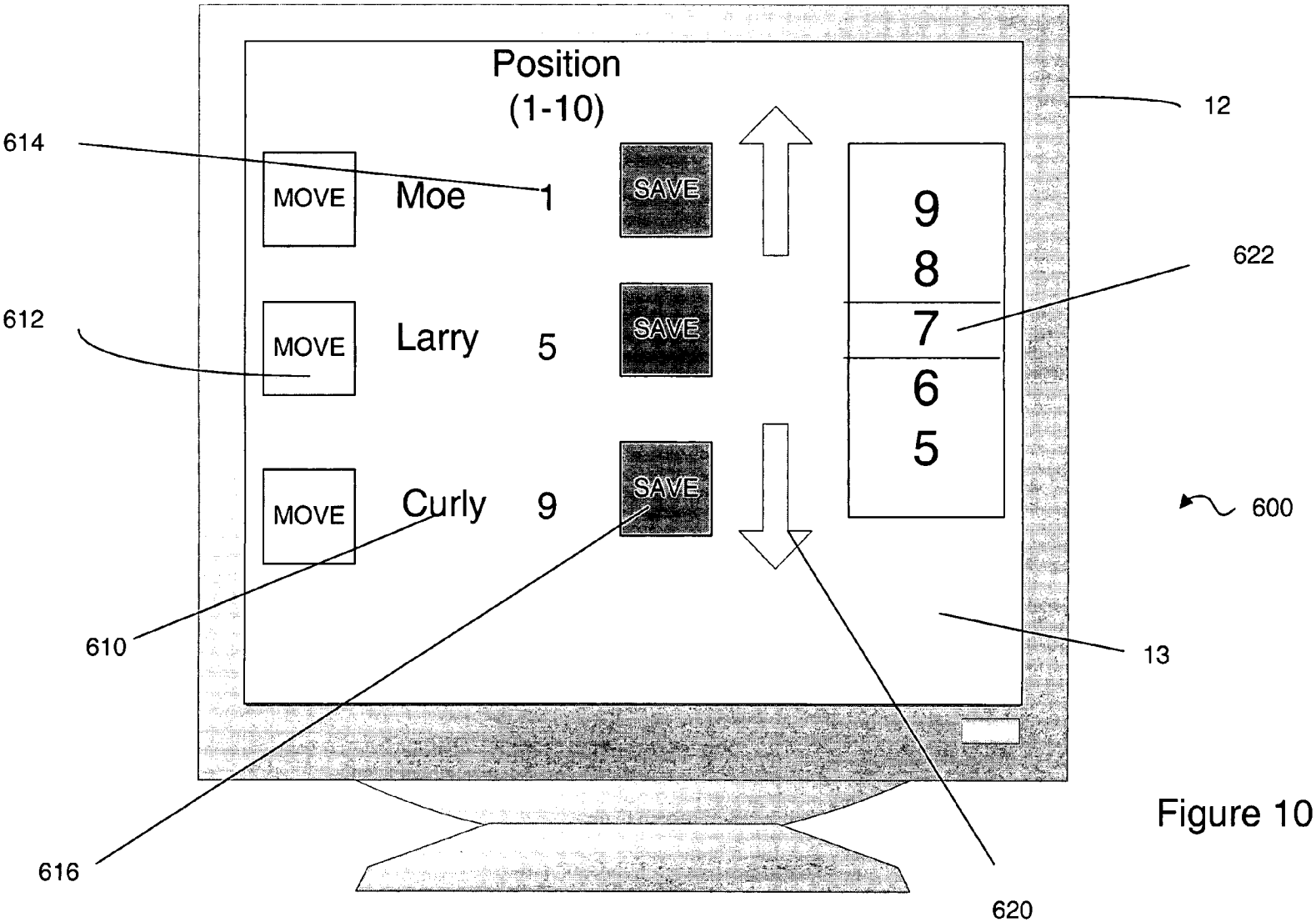
FIG. 10 illustrates a front view of another exemplary embodiment of a user interface for manipulating an adjustable palm rest.

Further, FIG. 10 illustrates an exemplary embodiment of a user interface 600 in use with a motorized adjustable palm rest. Displayed via a display 12 and screen 13, interface 600 provides several control options. Display 12 is operably connected to a CPU 14 and a user input device. In this exemplary user interface, user option are organized in columns across screen 13 while options associated with each of three users, here labeled "Moe," "Larry, and "Curly." User interface 600 lists various characteristics such as user id 610 and a palm rest characteristic 614 currently associated with a user id 610. Interface 600 also includes a number of functional keys including default button 612, save button 616, scroll arrows 620, and characteristic display 622. For example, should palm rest be desired to move to a characteristic 614 associated with "Moe," e.g. position 1, a user such as Moe, will via a mouse, scroll ball, or directly via touch screen, select the "Move" button 612 in the row with "Moe." This input will cause a motor to adjust palm rest 40 to a pre-set position. Additionally, a characteristic 614 associated with user id 610 may be modified. A user may utilize scroll arrows 620 to move through characteristics 614. When characteristic display 622 indicates a desired characteristic 614, a user selects "Save" button to cause CPU 14 to store the characteristic 614. For example, if "Save" button 614 associated with "Moe" was currently depressed, Moe's position would thereafter be "7" until otherwise modified.

When palm rest 40 is adjusted based upon user interface control, for example utilizing user interface 600 as shown in FIG. 10, certain motors including stepper motors may be utilized that may be controlled, receive input, give feedback, and cause movement accordingly. Additionally sensor devices may be utilized in the keyboard to determine positioning etc. Sensors and motors capable of being operated as described are known.

While the invention has been described with respect to specific examples including presently preferred modes of carrying out the invention, those skilled in the art will appreciate that there are numerous variations and permutations of the above described systems and techniques. Thus, the spirit and scope of the invention should be construed broadly as set forth in the appended claims.

I claim:

1. A device comprising:

a keyboard, having a housing;

a palm rest platform movably coupled to the housing;

a lift mechanism configured to adjust the palm rest platform;

an electric motor operatively coupled to the lift mechanism;

at least one first user interface member, wherein a current position of the palm rest platform is saved as a user preference as a result of an exterior force being applied to the at least one user interface member for at least one first time duration; and wherein the position of the palm rest position is varied to the saved user preference position of the palm rest platform as a result of an exterior force being applied to the at least one user interface member for at least one second time duration.

2. The device of claim 1, further comprising a second user interface member operative to control the lift mechanism.

3. The device of claim 2, wherein the position of the palm rest platform is varied by the lift mechanism as a result of an exterior force being applied to the second user interface member.

4. The device of claim 2, wherein the second user interface member is a frusto-conical shaped plastic member.

5. The device of claim 2, wherein the second user interface member comprises a raised button comprising two wedge sides, wherein each of the two wedge sides remain elevated in an initial position when no user input is being received.

6. The device of claim 2, wherein the second user interface member comprises at least two buttons.

7. The device of claim 1, wherein the user interface is a plurality of keys on the keyboard.

8. The device of claim 7, wherein depression of one of the plurality of keys on the keyboard causes the motor to vary the position of the palm rest platform.

9. The device of claim 1, wherein the lift mechanism includes a plurality of cam blocks.

10. The device of claim 1, wherein the lift mechanism is a lift leg.

11. The device of claim 10, wherein the lift leg is an eccentric cam lift leg including an irregular protrusion configured to cause the palm rest platform to be raised when the irregular protrusion is rotated.

12. The device of claim 1, further comprising a clutch mechanism operatively coupled to the lift mechanism.

13. The device of claim 12, wherein the clutch mechanism includes a plurality of pawls.

14. A device comprising:

a keyboard operably coupled to a computing device;

a palm rest platform movably coupled to the keyboard;

a lift mechanism configured to adjust the palm rest platform operably coupled to at least one electric motor;

a plurality of user interface members, wherein a current position of the palm rest platform is saved as a user preference associated with at least one of the plurality of user interface members as a result of an exterior force being applied to the at least one of the plurality of user interface members for at least one first time duration, and wherein the position of the palm rest position is varied to the saved user preference position of the palm rest platform associated with the at least one of the plurality of user interface members as a result of an exterior force being applied to the at least one of the plurality of user interface members for at least one second time duration;

at least one second user interface member, wherein the position of the palm rest platform is varied by the lift mechanism as a result of an exterior force being applied to the second user interface member;

wherein the lift mechanism comprises at least one of a plurality of cam blocks and a lift leg; and wherein the at least one second user interface member comprises at least one of a pair of buttons, a raised button comprising two wedge sides, a frusto-conical body member, and a cylindrical housing coupled to at least two paddles.

* * * * *